US010562691B2

(12) United States Patent
Krammer

(10) Patent No.: US 10,562,691 B2
(45) Date of Patent: Feb. 18, 2020

(54) CONTAINER AND METHOD FOR ADDING A MIXTURE COMPONENT

(71) Applicant: ALPLA WERKE ALWIN LEHNER GMBH & CO. KG, Hard (AT)

(72) Inventor: Christian Krammer, Campinas (BR)

(73) Assignee: ALPLA WERKE ALWIN LEHNER GMBH & CO. KG (AT)

( * ) Notice: Subject to any disclaimer, the term of this patent is extended or adjusted under 35 U.S.C. 154(b) by 526 days.

(21) Appl. No.: 14/438,096

(22) PCT Filed: Oct. 17, 2013

(86) PCT No.: PCT/EP2013/071683
§ 371 (c)(1),
(2) Date: Apr. 23, 2015

(87) PCT Pub. No.: WO2014/063981
PCT Pub. Date: May 1, 2014

(65) Prior Publication Data

US 2015/0251837 A1 Sep. 10, 2015

(30) Foreign Application Priority Data

Oct. 23, 2012 (CH) ..... 02072/12

(51) Int. Cl.
*B65D 81/32* (2006.01)
*B65D 51/28* (2006.01)
*B65B 3/04* (2006.01)

(52) U.S. Cl.
CPC ..... *B65D 81/3211* (2013.01); *B65B 3/04* (2013.01); *B65D 51/2835* (2013.01)

(58) Field of Classification Search
CPC ..... B65D 81/3211; B65D 51/2835; B65D 2101/0023; B65D 2101/0092; B65B 3/04
(Continued)

(56) References Cited

U.S. PATENT DOCUMENTS 6,152,296 A * 11/2000 Shih ..... B65D 51/2835 206/222
6,293,395 B1 9/2001 Hof
(Continued)

FOREIGN PATENT DOCUMENTS

WO 1989000959 A1 2/1989
WO 2006122612 A1 11/2006
(Continued)

*Primary Examiner* — Jacob K Ackun
*Assistant Examiner* — Jenine Pagan
(74) *Attorney, Agent, or Firm* — Morriss O'Bryant Compagni Cannon, PLLC

(57) ABSTRACT

The invention relates to a container and to the use thereof. The container has a chamber with a base for receiving a mixture component and an adapter for fixing the chamber to a second container. The adapter is connected to the chamber via a first connector and has a second connector to connect to the second container. Additionally, the adapter forms a flow channel for the mixture component extending between the first and the second connector. The adapter also has a blade element in the flow channel comprising a blade facing the base of the chamber in order to open the base. The first connector allows the chamber to rotate relative to the adapter and to the blade, said blade designed to cut through the base of the chamber along the edge of the base while the chamber rotates.

31 Claims, 2 Drawing Sheets

(58) Field of Classification Search
USPC ..... 206/219, 222, 217, 568; 215/6, DIG. 8
See application file for complete search history.

(56) References Cited

U.S. PATENT DOCUMENTS

| | | | | |
|---|---|---|---|---|
| 6,527,110 | B2 * | 3/2003 | Moscovitz | B65D 51/2835 206/222 |
| 6,935,493 | B2 * | 8/2005 | Cho | B65D 51/2835 206/222 |
| 6,974,024 | B2 * | 12/2005 | Cho | B65D 51/2864 206/219 |
| 7,506,782 | B2 * | 3/2009 | Walters | B65D 51/2835 206/219 |
| 9,004,302 | B2 * | 4/2015 | Ginzburg | B65D 51/227 206/0.5 |
| 9,499,316 | B2 * | 11/2016 | Hasegawa | B65D 51/2821 |
| 2002/0066677 | A1 | 6/2002 | Moscovitz | |
| 2003/0089627 | A1 * | 5/2003 | Chelles | B65D 51/2821 206/219 |
| 2007/0023299 | A1 * | 2/2007 | Clarkson | B65D 51/2835 206/219 |
| 2007/0039975 | A1 * | 2/2007 | Bochtler | B65D 71/502 222/142.5 |
| 2007/0280042 | A1 * | 12/2007 | Yamanaka | B65D 51/2821 366/185 |
| 2010/0236952 | A1 * | 9/2010 | Masterson | B65D 51/2835 206/222 |

FOREIGN PATENT DOCUMENTS

| | | | |
|---|---|---|---|
| WO | 2011029731 | A1 | 3/2011 |
| WO | 2011030173 | A1 | 3/2011 |

* cited by examiner

CONTAINER AND METHOD FOR ADDING A MIXTURE COMPONENT

CROSS-REFERENCE TO RELATED APPLICATIONS

This application is a national phase entry under 35 U.S.C. § of PCT/EP2013/071683 filed on Oct. 17, 2013, which claims priority to Swiss Patent Application 02072/12 filed on Oct. 23, 2012, the entirety of each of which is incorporated by this reference.

TECHNICAL FIELD

The invention relates to a container, particularly to an attachment for bottles, for receiving a mixture component and delivery thereof into a second container, The invention further relates to a method for adding a mixture component using such a container or attachment.

PRIOR ART

Various containers are known from the prior art—mostly in the form of attachments for bottles—which make it possible to fill and store components of a mixture, such as of a mixed beverage, separately and to mix them together only as needed. This is beneficial, for example, if the components react with each other or if the mixture has a shorter shelf life than the individual components from which it is composed.

WO 2006/122612 A1 describes an attachment for bottles for the preparation of a mixed beverage having a housing with a pour spout that is designed to receive a mixture component. As needed, the mixture component can be mixed via an additional (normally sealed) opening into a base liquid contained in a bottle. The housing is subdivided for this purpose by a base part into a receiving chamber and a connection port for connecting to the bottle. The housing is equipped with a break-open device that can be received in the connection port and serves to open a segment of the base part with a predetermined breaking point.

A storage container is known from US 2002/0066677 A1 that can be connected to a bottle in order to add to it a substance present in the storage container. The device has a housing for receiving the substance and an openable seal that is arranged in the housing. In addition, a break-open section is provided that is positioned in the housing between the seal and the housing opening and is designed to be pressed from the bottle through the seal upon connection of the storage container to the bottle, The break-open section has the shape of a tip and penetrates through the center of the seal.

The variant described in U.S. Pat. No. 6,293,395 B1 has several containers, each of which is filled with different substances and provided with lids. When the containers are connected, the lids are pressed from the container openings as a whole, thus going into the interior of the containers.

ADVANTAGES OF THE INVENTION

It is an advantage of the present invention to provide a container that enables a reliable mixing of two components and is simple and cost-effective to manufacture. Additional advantages of the present invention follow from the following description.

SUMMARY OF THE INVENTION

The abovementioned advantages are achieved according to the invention by a container and the use thereof according to present invention.

It is particularly a container having a chamber with a base for receiving a mixture component and an adapter for fastening the chamber to a second container. The adapter is connected via a first connecting means to the chamber and has a second connecting means for connecting to the second container. In addition, the adapter forms a flow channel for the mixture component extending between the first and the second connecting means. Moreover, the adapter has a blade element in the flow channel with a blade facing toward the base of the chamber for opening the base of the chamber. The first connecting means enables a rotation of the chamber relative to the blade and expediently also relative to the adapter, the blade being designed to cut through the base of the chamber along its edge upon rotation of the chamber. The cut can be circular, It is advantageous if the chamber and the adapter are non-detachably connected to one another.

Additional embodiments are described below, and the features mentioned (individually) in this context are to be regarded as being features that can be realized separately (as part of any container) or—insofar as they are not contradictory—in any combination.

The mixture component can be present as a solid (e.g., a powder), a liquid or a paste.

The first connecting means enables movement of the chamber in the direction of the second connecting means and/or toward the adapter and/or (completely or partially) into the adapter, the blade being designed to come into contact with the base of the chamber during said movement of the chamber and to release it from the chamber along a circle or circular arc and/or along its edge. Expediently, the chamber can also be rotated relative to the blade and also relative to the adapter for this purpose. This rotatability can advantageously be enabled by the first connecting means.

The opening of the chamber base does not occur automatically upon connection of the container to the second container as is known from the prior art. The opening of the chamber base can advantageously be executed independently of a connection of the container to or with the second container and/or before or after such a connection.

According to one embodiment, the blade is embodied so as to detach the base of the chamber only partially from the chamber upon rotation, particularly maximum rotation, of the chamber. In this way, the base or the part cut from the base remains connected to the chamber and cannot fall into the adapter or second container, For the cited purpose (or for other purposes, e.g., in the event that several blades are present), the rotation of the chamber relative to the blade or relative to the adapter can be limited in relation to the maximum rotation angle. This can be achieved by a stop that defined the maximum rotation angle.

The container can advantageously be characterized in that the rotation of the chamber relative to the adapter is limited in relation to the maximum rotation angle to less than 360 degrees, or less than 350 degrees. However, the rotation angle can also be limited to less than 180 or 170 degrees (e.g., if two blades are provided) or less than 120 or 110 degrees (e.g., if three blades are provided). Alternatively or in addition thereto, the rotation of the chamber relative to the adapter can be limited with respect to the maximum rotation angle by stops. Also alternatively or in addition to that described above, the chamber and the adapter can be connected to each other such that the rotation of the chamber relative to the adapter for the opening of the base of the chamber can occur clockwise or counter-clockwise.

Furthermore, a provision can be made that the rotation of the chamber relative to the adapter occurs in a restraint-guided manner. Through the restricted guidance of the rotational manual movement, the chamber can advantageously be displaced in the translational direction and/or the manual rotation of the chamber relative to the adapter can bring about a convergence between chamber and blade and thus the opening of the base in a restraint-guided manner.

According to a variant, the chamber or at least its base-side end can be received, for example by being screwed, completely or partially into the adapter. For this purpose, it is advantageous if the outer cross section or contour of the chamber corresponds substantially to the inner cross section or contour of the adapter, The chamber has an at least partially (substantially) cylindrical, particularly circular-cylindrical, outer (and also inner) shape, with the same applying to the inner (and also the outer) shape of the adapter. The inner and outer shapes are substantially defined by the outside and the inside of the side walls of the chamber and adapter. This also applies at least to the two ends of the chamber or adapter facing toward each other, particularly at a length that corresponds substantially to the distance of the blade element from the edge of the opening on the side of the first connecting means, i.e., of the chamber-side opening of the adapter.

The maximum outer diameter of the chamber is smaller at the base-side end and larger at the end facing away from the adapter than the maximum inner diameter of the adapter at the end facing toward the chamber. Expediently, said diameter or the outer cross section of the chamber becomes larger from the base-side end in the direction of the opposing end. The same also applies to the maximum inner diameter of the chamber or the cross section of its hollow space, As described above, the base-side end of the chamber is received in the adapter, for which reason its outer cross section corresponds (substantially) to the inner cross section of the adapter on the side facing toward the chamber.

The chamber is expanded in the area that is not received in the adapter. As a result, an increase in the volume of the chamber is achieved without having to adapt the size of the adapter or increasing the length of the chamber too much.

When a diameter is mentioned, this is intended to disclose, besides the diameter, the corresponding dimensions at a right angle to the axis of rotation or to the longitudinal axis of the chamber or of the adapter as well; after all, diameters are only defined for circular shapes. For example, besides the cited maximum inner or outer diameter (of the chamber or of the adapter), the maximum distance of the inner wall or outer wall from the longitudinal axis is also disclosed. When a cross section is mentioned, this discloses the cross-sectional surface on the one hand and the edge or contour of the cross-sectional surface on the other hand.

It is advantageous if the chamber has a projection on its outside, particularly on its side wall, Expediently, the maximum outer diameter of the chamber is greater at the location of the projection than the maximum inner diameter of the adapter or its opening on the side facing toward the chamber. Alternatively, it could also be said that the projection protrudes beyond the edge of the adapter or extends beyond the edge of the opening in which the chamber is received. Advantageously, a spacer that can particularly be removed manually is provided between the projection and the edge of the adapter that prevents a convergence of the projection and the edge. In this way, contact between the blade and the part of the chamber base to be opened and hence an inadvertent release of the mixture component can be prevented. The spacer is a tamper-evident band that is expediently connected via predetermined breaking points to the chamber (particularly the projection) and/or the adapter (particularly its abovementioned edge).

Alternatively or in addition thereto, the container can also be characterized in that the abovementioned projection encloses the chamber along its periphery, the projection forming a seal that is designed to cooperate therewith in a sealing manner upon contact with said edge of the adapter.

According to another embodiment, the chamber has a seal between blade element (particularly blade) and chamber (particularly chamber base). The seal occurs through the contact of the blade element (particularly the blade) with the chamber (particularly the chamber base). Expediently, the seal extends along the edge of the base, particularly along the inside of the side wall of the chamber. The seal is designed to come into contact with the blade element (particularly with the blade) and to cooperate therewith in a sealing manner. The contact occurs before or while the blade is in contact with the part to be severed (particularly a weakened area or a predetermined breaking point) of the base. In this way, a seal is established before or during opening at the places in which the chamber is opened. For this purpose, the seal can be arranged nearer to the blade than to the part of the base to be severed. For example, the part of the base to be severed can be arranged in a recess in the base.

The abovementioned seals prevent the mixture component from emerging g between the cited parts, i.e., between projection and adapter edge or between blade and chamber, Advantageously, one or both seals are formed by a circumferential cylindrical surface or conical surface (running along the inside or the outside of the adapter and/or the chamber) or in general by a circumferential projection.

It is advantageous if the chamber and the adapter are non-detachably connected to one another. The chamber cannot be separated from the adapter (particularly by hand) without the use of force and/or destruction. In addition to its usual meaning, the term "non-detachable" is also intended to disclose, alternatively or in addition, the meaning of "unlosable." The unlosable connection may be established by the first connecting means or by another means.

According to another embodiment, the container can be designed for one-time use. It is possible for the container to remain connected to the second container until its disposal once it is connected to the second container. The material or materials from which the first container is made can be recycled together with the material or materials from which the second container is made. Expediently, both containers are made of plastic. Independently thereof, it is advantageous if the container has a safeguard that prevents the removal of the container from the second container. It is also possible for the container, after having been mounted on the second container, to be non-detachably connected thereto, thus resulting, according to another exemplary embodiment of the invention, in a complete container, a plastic container, particularly consisting of a second container, that contains a supply of a substance (such as a liquid) to which the mixture component is added, and a container that contains a supply of the mixture component.

The first connecting means, which is used to connect the chamber to the adapter, has a first guide track and a moveable sliding projection guided along (or in) the first guide track. At least one end of the first guide track is expediently embodied as a stop for the sliding projection, so that the sliding projection cannot leave the guide track. If rotation of the chamber relative to the adapter is provided, then it is advantageous if the first guide track (substantially) has the shape of a helix or a helicoid (with substantially constant or changing pitch). The first guide track can (particularly through its length) additionally define the maximum rotation angle. On the other hand, if the chamber can be moved linearly toward the blade element, linear guide tracks also merit consideration. Also conceivable are circular arc-shaped guide tracks or combinations of those mentioned above. For example, the first guide track could define a linear movement of the chamber in the direction of the blade element by means of a linear section and enable a rotation of the chamber relative to the adapter by means of a circular arc-shaped section adjacent thereto. Expediently, one, two, three or more (first) guide tracks are provided, and they are arranged (substantially) equidistant from one another. The first guide track is provided on the chamber; alternatively, however, it can also be arranged on the adapter. A sliding projection is expediently present for each guide track that is arranged on the respective other of the parts (chamber, adapter) that can be moved relative to each other.

A step (or, generally, a resistance) can be provided in the area of one or both ends of the first guide track, This step forms, in relation to the movement of the sliding projection along the first guide track, a resistance or the step requires increased expenditure of energy in order for the sliding projection to overcome it compared to the movement of the sliding projection along areas of the first guide track in which steps are not provided. The step can be embodied such that it can (only) be overcome in one or both directions of motion (without destruction). A recess can be embodied between the step and the above-described stop, or the end of the guide track, in which the sliding projection can be reversibly or irreversibly fixed. In this way, the position of the chamber relative to the adapter can be fixed reversibly or irreversibly. The sliding projection is fixed reversibly, so that the sliding projection can be removed from the recess through a movement in the direction of the step while overcoming a resistance. The distance of the step from the end of the first guide track corresponds substantially to the expansion of the sliding projection in the direction of movement.

According to one advantageous embodiment, another (second) guide track is provided that is shorter compared to the first guide track, the second guide track and the first guide track meeting each other at an acute angle in the area of their ends. A step (or, generally, a resistance), is provided in the area of the other end of the second guide track, with reference being made to the above remarks with regard to the embodiment thereof. The second, shorter guide track has the shape of a circular arc and runs at a (substantially) constant distance to the chamber base. It makes it possible, after the opening of the base, to rotate the chamber relative to the adapter in the opposite direction, whereby the sliding projection can move from the first to the second guide track and finally reach the end thereof, which can form a stop and thus enable transmission of the torque from the chamber to the adapter. This can enable the removal of the adapter from the second container by means of a rotational movement.

The second container is a container with an opening and a thread, particularly an outer thread, it being expedient for the thread to be arranged at the opening. The second container may be a bottle. Accordingly, the second connecting means may be a thread, it being embodied so as to cooperate with the thread of the container. However, the second connecting means can also be a bayonet joint or another positive connection.

The chamber and/or the adapter are advantageously manufactured by means of injection molding. Expediently, the chamber and/or the adapter are made of plastic. Exemplar materials are: HDPE, LDPE, PP, PET as well as mixtures or (if composed of several parts) combinations of the abovementioned plastic, it being possible for the chamber and the adapter to be made of the same or from different materials. By making the adapter and the chamber as respective plastic injection-molded parts, large quantities can be manufactured cost-effectively.

Moreover, it is advantageous if the chamber has a pour spout on its end opposite from or facing away from the adapter. The opening is sealed and openable and/or resealable (for example by hand). For example, the opening can be sealed with a film or by means of a lid that is connected, for example, via a twist cap to the chamber.

However, a provision can also be made that the chamber (particularly at the abovementioned location) does not have an openable pour spout. This depends on whether the container is provided so as to remain connected to the second container after connection thereto and the addition of the mixture component or whether it is to be removed again. If a permanent connection is intended, then it is expedient if the container and/or the second container are provided with a screw lock that prevents removal of the container from the second container.

The blade element and/or the blade is firmly attached to the adapter in a rotational and/or translational direction or so as to be immovable relative thereto. The adapter and the blade element and/or the adapter and the blade may be integrally formed. As a result, the blade and the adapter can be fixed relative to one another.

Moreover, the blade element has a round or circular flow opening for the mixture component. The blade is expediently arranged on the edge of the flow opening. Expressed more generally, the blade is (or the blades are) arranged on a circle whose midpoint is defined by the axis of rotation (rotation of the chamber relative to the adapter). The blade itself can be circular or circular arc-shaped. Namely, the flow opening can have any shape, with an opening that extends to the circle. Alternatively or in addition thereto, the blade element can have a circular projection or collar extending in the direction of the chamber, the blade being arranged on it.

The blade and/or the blade element can be embodied such that the part of the base cut out of the base can be lifted by the blade and/or the blade element during cutting successively or only after cutting and optionally be fixed in a position so that, on the one hand, the mixture component can be fed completely to the second container and, on the other hand, the cut-off part of the base remains in the adapter, i.e., it cannot fall into the adapter and/or the second container. It is also possible for the cut-off part of the base to be fixed in a lifted position after completion of the cutting process. It should also be noted that the mixture component is fed by gravity from the chamber to the second container, whereby additional auxiliary means for emptying the chamber can be omitted.

Furthermore, in the area in which the blade touches the base, or cuts the sub-area out of the base, the base can be thinner than the rest of the base. This sub-area can mostly have a circular ring shape. As a result of such thinning, the translational force to be applied to the blade can be reduced compared to the force applied to a base that is not thinned out.

More than one blade can be provided, or the blade can have one or more tips. If several tips or several blades are provided, then at least two distances (not interrupted by another tip or blade) exist between (one or two different) pairs of neighboring tips or blades that are different from each other. For example, if only two blades are present, then they are arranged so as not to be exactly opposite one another in relation to the flow opening. If the maximum rotation angle of the chamber relative to the adapter is (substantially) defined or limited (substantially) by the second-largest of the distances, then a connection between the base and the chamber remains after rotation, whereby the base can fold away and not fall off. Expressed more generally, the maximum rotation angle should be less than the rotation angle that is defined by the greatest distance. The distances define chords and circular arcs of the abovementioned circle whose midpoint is defined by the axis of rotation (rotation of the chamber relative to the adapter) and its radius by the distance of the blades or tips from the midpoint. The chords or circular arcs (i.e., the lengths thereof) clearly define an angle including, among others, the abovementioned maximum rotation angle. The maximum rotation angle can be predetermined, for example, by the stops in the guide tracks between which the sliding projection can be moved in a guided manner.

It is advantageous if the flow opening narrows in the direction of the second connecting means and/or if the blade element forms a funnel. A (particularly annular) recess is located between the blade element (particularly between the funnel) and the side wall of the adapter, the recess or its opening pointing in the same direction as the opening of the adapter on the side of the second connecting means. The recess serves to receive the edge of the opening of the second container. Alternatively or in addition, the funnel is embodied so as to protrude into the second container or its opening when the container is connected to the second container.

According to one variant of an embodiment, a provision can be made that the chamber forms a hollow space in which the blade is arranged. The hollow space can be a niche.

The specifications on this variant refer, if nothing to the contrary is indicated, to the state of the container in which the blade is located in its initial position, i.e., to the state of the container before the opening of the chamber base by the blade.

The hollow space can be formed, for example, by the base and/or by the side wall of the chamber. Moreover, it is advantageous if the hollow space is open on one side and the blade and/or the blade element protrudes through this open side into the hollow space. The open side is the side facing toward the second connecting means.

The hollow space is advantageously separated from the inside of the chamber and/or the mixture component by walls. These can be formed by the base and/or the side wall of the chamber.

Expressed more generally, it can be advantageous if the blade element and/or the blade are arranged completely or partially:

- within the side wall of the chamber or within the prismatic body (particularly circular cylinder) defined by the side wall of the chamber and/or
- on the side facing toward the inside of the chamber of a plane defined by the chamber base (or at least by the part thereof to be opened by the blade in a circular manner) or on this plane.

As a result, it is possible for the opening of the base to be done through a rotational movement of the chamber relative to the adapter without a movement of the chamber toward the adapter and/or into same occurring or having to occur. According to one embodiment, the container is characterized in that

- the blade is embodied so as to detach the base of the chamber along its edge only partially from the chamber upon rotation of the chamber, the rotation of the chamber relative to the adapter being limited with respect to the maximum rotation angle for this purpose,
- the blade element connected to the adapter has a flow opening for the mixture component, the blade being arranged on the edge of the flow opening,
- the flow opening narrows in the direction of the second connecting means, thus forming a funnel, a recess for receiving the edge of the opening of the second container being provided between the funnel and the side wall of the adapter,
- the chamber has a projection on its outside, with an outer diameter of the chamber at the location of the projection being greater than an inner diameter of the adapter on the side facing toward the chamber, the projection enclosing the chamber at least in part along its periphery.

Also disclosed herein are the use of the container described in this document and a method for adding a mixture component to a second container using the container described in this document.

In the abovementioned method and in the abovementioned use, the adapter may be attached by means of the second connecting means to the opening of the second container (particularly screwed), the chamber is rotated relative to the adapter or at least toward it and/or moved into same, the blade opens the base of the chamber and the mixture component flows from the chamber via the adapter into the second container.

According to one embodiment, the abovementioned use and the described method contain as steps one or more actions that have been described in the form of the suitability, capabilities or characteristics of the container.

In addition, a method for filling the container described in this document with a mixture component is also disclosed herein. This method is advantageously characterized in that the filling the chamber with the mixture component is done through a second opening (fill opening) that is different from the opening in the flow channel that is sealed by the base. Ideally, the fill opening lies opposite the opening in the flow channel. After filling of the container or of the chamber with the mixture component, the fill opening can be sealed, for example, by a sealing film, particularly a hot-sealing film. Optionally, the seal of the fill opening can be opened or removed after the base of the chamber has been opened by the blade and the mixture component has been fed to the second container through the opening formed in this way in the flow channel. The abovementioned second opening, i.e., the (former) fill opening, can then be utilized as a pour spout for the contents of the second container. As a result, the removal of the container from the second container in order to pour out the contents of the second container can be omitted. The pour spout can also be sealable for its part by a closure such that, after each removal of a sub-quantity from the second container via the pour opening of the container, this pour spout can be sealed.

BRIEF DESCRIPTION OF THE DRAWINGS

The following schematic, scale representations are enclosed.

DETAILED DESCRIPTION OF THE INVENTION

The invention is explained below with reference to the drawings for the sake of example.

Figure 1A:
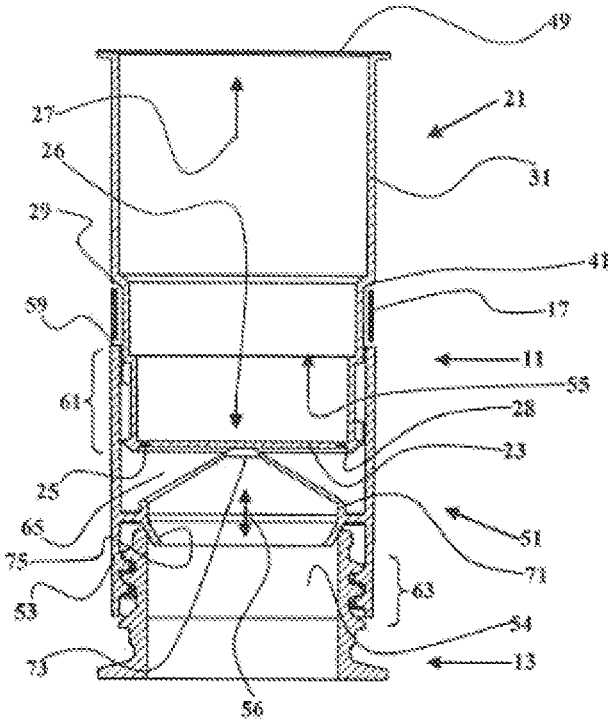
FIG. 1*a* shows a longitudinal section through a container with dosed chamber.
Figure 1B:
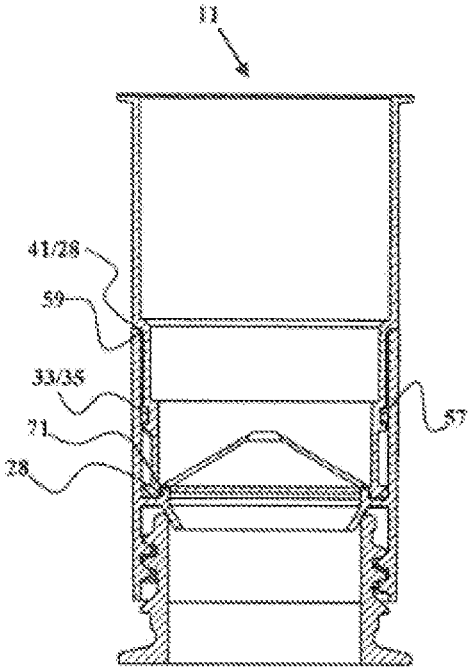
FIG. 1*b* shows a longitudinal section through a container with opened chamber.

FIGS. 1 and 1*b* show an embodiment of a proposed container 11 as an attachment for a second container 13, which is embodied as a bottle in the present exemplary embodiment. The container 11 has a chamber 21 for receiving a mixture component and a part referred to as an adapter 51. The adapter 51 serves to connect the container 11 to the second container 13 on the one hand in order to add the mixture component to the latter. On the other hand, the adapter 51 fulfills the purpose of opening the chamber 21 of the container 11, thus releasing the mixture component so that it can flow through the flow channel 65 of the adapter 51 into the second container 13. The adapter 51 is non-detachably connected via a first connecting means 61 to the chamber 21 and also has a second connecting means 63 for attachment to the second container 13. The second connecting means 63 is a thread, particularly an internal thread, for attachment to a corresponding thread, particularly an external thread, at the opening of the second container 13. The latter is generally a bottle with a neck or port having the described thread. The first connecting means 61 enables the chamber 21 to move toward the adapter 51. In the present example, the chamber 21 can be moved into the adapter 51, the first connecting means 61 producing a restraint-guided rotational movement of the chamber 21 relative to the adapter 51 upon convergence of the chamber 21 and the adapter 51. Expediently, both the adapter 51 and the chamber 21 are substantially cylindrical at their mutually facing ends, the outer diameter or the outer contour of the chamber 21 at the described ends corresponding substantially to the Inner diameter or the inner contour of the adapter 51. As a result, the chamber 21 can be partially pushed into the adapter 51, i.e., into its one opening 55, and rotated. At the end facing toward the adapter 51, the chamber 21 has a base 23 with one or more weakened areas or thinned portions 25. Expediently, the weakened area 25 is substantially circular. It runs substantially along the inner edge of the chamber 21 or at least at a substantially constant distance thereto. The weakened area 25 is embodied so as to cooperate with a blade element 71 which is arranged in the adapter 51 between the first connecting means 61 and the second connecting means 63. The blade element 71 is stationary and/or immobile with respect to the adapter 51. The blade element 71 is part of the adapter 51 and/or if the blade element 71 and the adapter 51 are integrally formed. If the chamber 21 now moves toward the adapter 51 or Into same, the base 23 comes Into contact with the blade element 71, I.e., with its blade 73, particularly at the location of the weakened area 25. Through the rotational movement of the chamber 21, the blade 73 Is guided along the weakened area 25 and opens the base 23 of the chamber 21 in a circular manner. The base 23 remains connected to the chamber 21 at one place in the final position of the blade 73 (i.e., when the base 23 is completely opened). The remaining connection between base 23 and chamber 21 enables the base 23 to fold into chamber 21 or out of the chamber 21. The base 23 is thus opened without falling off and possibly getting lost. In order to achieve this, various possibilities merit consideration. Expediently, the movement of the chamber 21 Into the adapter 51 and/or the rotational movement of the chamber 21 is limited. This can be brought about, for example, by the first connecting means 61. However, the movement of the chamber 21 into the adapter 51 can also be limited by the cooperation of a projection 41 with the edge 59 of the adapter 51. The projection 41, formed by an expansion of the chamber 21 In the present example, extends circumferentially in a circular manner on the side wall 31 of the chamber 21. When the chamber 21 moves in the direction of the adapter 51, the projection 41 moves nearer to the edge 59 of the adapter 51. The distance between projection 41 and edge 59 thus defines and limits how far the chamber 21 can be moved into the adapter 51, and the projection 41 forms a stop. In the unopened state, a spacer 17 can be provided between projection 41 and edge 59 that prevents a convergence of the projection 41 and the edge 59 and hence a convergence of the blade element 71 and the base 23 of the chamber 51. The spacer 17 is embodied so as to be removable, particularly removable by hand. The blade element 71 has an opening 56 that enables the mixture component flowing from the base 23 out of the chamber 21 into the adapter 51 to pass toward the opening 56, which leads to or transitions into the opening 54 of the second container 13. The opening 56 of the blade element 71 narrows in the direction of flow of the mixing component, i.e., in the direction from the chamber 21 toward the second container 13. The blade element 71 forms a sort of funnel 75, with its opening width on the side facing toward the second container 13 being smaller than the opening width of the opening of the second container 13. In the depicted example, the port or neck of the second container 13 Is received (In the (final) state connected to the adapter 51) between the side wall 53 of the adapter 51 and the funnel 75. This prevents the mixture component from getting into the area of the second connecting means 63, which would contaminate the bottleneck of the container 13. This is important particularly if the container 11 is to be removed after the mixture component has been added to the second container 13. After all, there are essentially two use variations. According to a first variant, the container 11 is connected to the second container 13 and, after the addition of the mixture component, a lid 49 (alternatively also a film) that seals the opening 27 of the chamber 21, removed, and the mixture present In the second container 13 can be poured out through the opening 54 of the second container 13 via the adapter 51 and the chamber 21. In this case, the container 11 has a safeguard to prevent removal of the container 11 from the second container 13. According to a second variant, the container 11 is removed from the second container 13 after the addition of the mixture component. In this case, the opening 27 or the presence of the removable lid 49 or of the film is not necessary. A contamination during removal of the container 11 can be prevented by the smaller opening width of the opening 56 In comparison to that of the opening 54 of the second container 13 (independently of the presence of a funnel 75). An additional improvement is achieved through the presence of the described funnel 75. Alternatively or in addition, a provision can be made (also Independently of the funnel shape) that the opening 56 of the blade element 71 has an edge protruding Into the opening of the second container 13 as shown in FIGS. 1*a* and 1*b* (blade element 71 protruding Into the opening of the second container 13). Improved tightness is also achieved through the described measure, and contact between the mixture component and the second connecting means 63 is also prevented. The seals 28 and 29 also comprise additional measures for improving the tightness. The seals 28, 29 are annular. The seal 28 extends along the weakened area 25 and can, like in the present exemplary embodiment, be embodied as part of the base 23. It conies Into contact with the blade 73 before or while the blade 73 comes into contact with the base 23 and/or begins to open the base 23. For example, the seal 28 can be nearer to the blade element 71 than the part of the base 23 coming into contact with the blade 73 or to be severed. For example, the weakened area 25 can be embodied as an area of the base with a lesser thickness. The thinner part of the base 23 can be arranged at a greater distance from the blade 73. An additional seal 29 is formed by the projection 41 and can also be arranged on, at, next to or along the projection. All that is relevant is that the edge 59 cooperate in a sealing manner with the projection 41 or with the part of the chamber 21 with which the edge 59 is in contact in this position during maximum convergence of (or minimum distance between) the chamber 21 and the adapter 51.

Figure 2A:
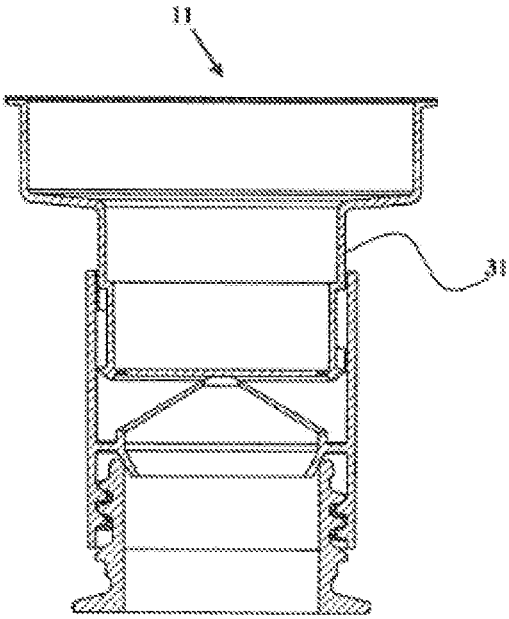
FIG. 2*a* shows a longitudinal section through a container with an expanded chamber with dosed base.
Figure 2B:
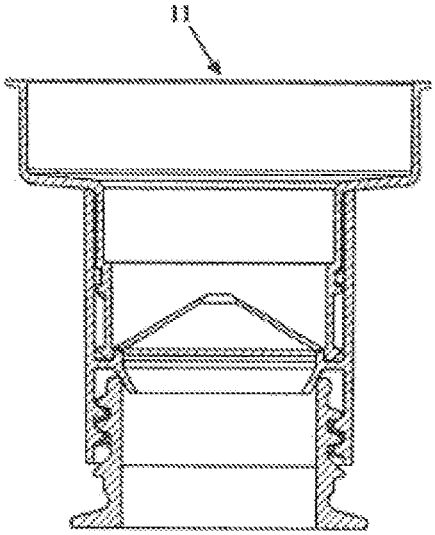
FIG. 2*b* shows a longitudinal section through a container with an expanded chamber with opened base.

FIGS. 2*a* and 2*b* represent a slightly modified variant of the container from FIGS. 1*a* and 1*b*. One difference from the design according to FIGS. 1*a* and 1*b* is the shape of the chamber 21. The chamber 21 expanded on the side facing away from the adapter 51. In particular, the inner diameter of the chamber 21 at that end is greater than the outer diameter of the adapter 51. In this way, a substantial increase in volume can be achieved without greatly increasing the length of the container 11.

Figure 3A:
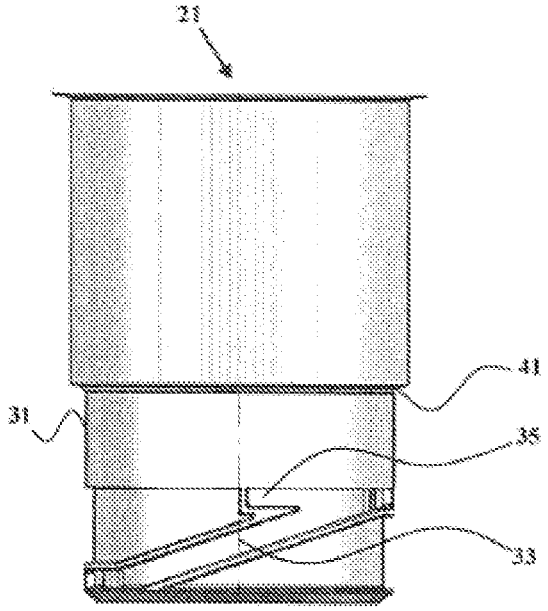
FIG. 3*a* shows a first side view of a chamber.
Figure 3B:
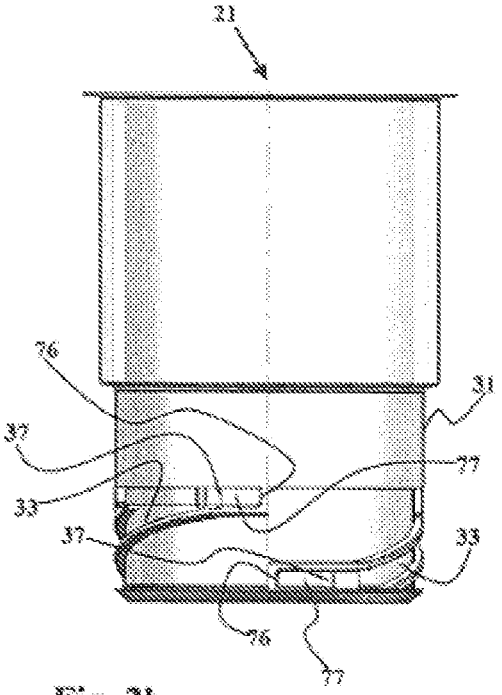
FIG. 3*b* shows a second side view of the chamber.
Figure 4:
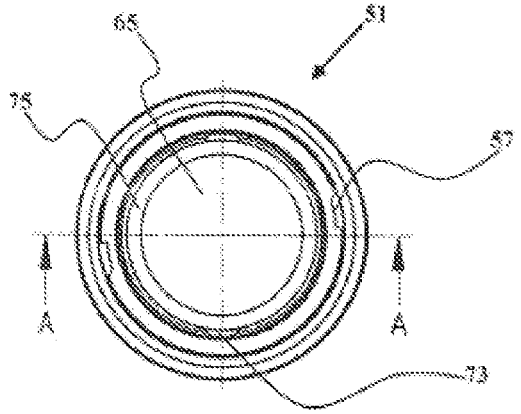
FIG. 4 shows a cross section through an adapter.

FIGS. 3*a* and 3*b* show two different views of the outside of the chamber 21 (corresponding to the chamber shown in FIGS. 1*a* and 1*b*). Clearly visible are the first connecting means 61 and the part thereof that is arranged on the chamber 21. Said part has a (first) guide track 33 that extents in the shape of a helix or a helicoid along the outside or side wall 31 of the chamber 21. Such a guide track 33 expediently runs around the chamber less than two times, particularly less than one time or one-half time. In the present exemplary embodiment, this guide track 33 defines the rotation angle of the chamber 21 relative to the adapter 51 necessary for the complete opening of the chamber 21. In particular, the guide track 33 forms a stop 76 at its end for the sliding projection 57 described further below, whereby the rotation angle is limited. Expediently, two or more such guide tracks 33 are provided, it being possible for them to be arranged in regular intervals along the periphery of the chamber 21. In FIGS. 3*a* and 3*b*, two guide tracks 33 of this type are provided on opposite sides of the chamber 21. This helical guide track 33 is used to screw the chamber 21 into the adapter 51, thus bringing the base 23 of the chamber 21 into contact with the blade 73 and moving it along the weakened area 25 in order to open the base 23. For this purpose, the adapter 51 is equipped with one sliding projection 57 (cf. FIG. 4) per guide track 33. Upon rotation of the chamber 21, it moves along the helical guide track 33, thus establishing a connection between the chamber 21 and the adapter 51, which enables the abovementioned rotatability of the chamber 21 relative to the adapter 51. Expediently, a step 37 is provided at the end of the helical guide track 33 nearer to the base 23 and/or further from the base 23 that offers a resistance to the movement of the sliding projection 57 in the guide track 33 (or beyond the step). After the resistance is overcome—through a rotation in a predetermined direction in the present exemplary embodiment—the sliding projection 57 reaches a recess 77 embodied so as to correspond to the sliding projection 57. The stop 76 that prevents further rotation of the sliding projection 57 is arranged in the direction of rotation. Counter to the direction of rotation, the step 37 is embodied such that the sliding projection 57 can leave the recess 77 in a restraint-guided manner in the direction of the helical guide track 33 under resistance but without destruction. Depending on the structure of the step 37, the sliding projection 57 can be reversibly or irreversibly fixed in the recess 77. The steps 37, or the recesses 77 in conjunction with the sliding projections 57, bring about a stabilization or fixation of the position of the chamber in its position nearest and/or furthest from the adapter 51. Optionally, an additional (and shorter) guide track 35 is present for each helical guide track 33. This second, shorter guide track 35 also runs along the periphery of the chamber 21 on its outside 31 but expediently at a constant distance to the base-side end of the chamber 21. The shorter guide track 35 transitions into the helical guide track 35, particularly in the area of the end of the helical guide track 35 further from the base 23 of the chamber 21. This results in a fork. If the chamber 21 is rotated in the opposite direction after the rotating and opening of the base 23, the sliding projection 57 moves from the end of the helical guide track 33 into the shorter guide track 35 and reaches its free end, which forms a stop 76 for the sliding projection 57, thus enabling transmission of the torque to the adapter 51. In this way, the chamber 21 and the adapter 51 can be removed from or screwed off of the second container 13 merely by rotating the chamber 21.

In the exemplary embodiment shown here, the chamber 21 and the adapter 51 with blade element 71 are each embodied in a single piece and made of plastic as a plastic injection-molded part, so that large quantities can be manufactured cost-effectively.

Figure 5A:
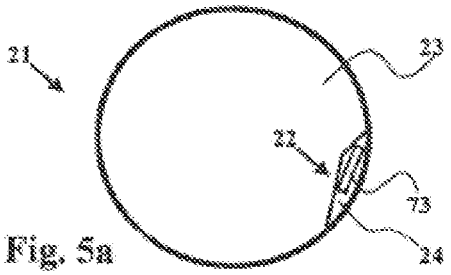
FIG. 5*a* shows a chamber with specially designed base from below.
Figure 5B:
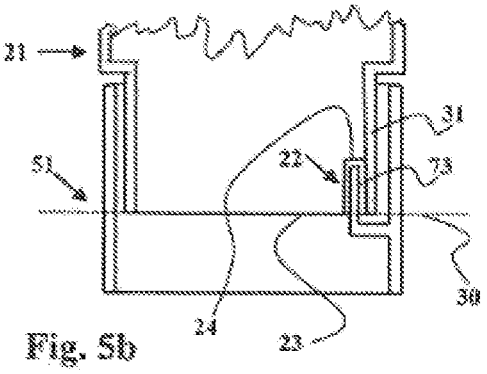
FIG. 5*b* shows a side view of the chamber from FIG. 5*a* and of an adapter.

FIGS. 5*a* and 5*b* show an embodiment of a container. Its distinctiveness lies in a niche 22 formed by the chamber 21 in which the blade 73 is arranged before the opening of the base 23 by the blade 73. For the sake of clarity, the cut edges are without hatching. The niche 22 can be formed by the base 23 and/or the side wall 31 of the chamber 21. The parts of the chamber 21 that form the niche 22 can also be referred to as a niche wall. Expressed generally, it can be advantageous if the blade 73 extends from one side of the plane 30 defined by the part of the base 30 to be opened in a circular manner, particularly before the opening of the base 23 by the blade 73 of the blade element. This makes it possible for the opening of the base 23 to occur as a result of a rotational movement of the chamber 21 relative to the adapter 51 without a movement of the chamber 21 toward the adapter 51 and/or into same occurring or having to occur. If the blade 73 is rotated relative to the adapter 51, it first severs the niche wall. Since the niche wall transitions into the base 23 of the chamber 21, the blade 73 then slides into the base 23 and severs it along its edge. A part 24 of the niche wall remains connected to the base 23 and the side wall 31 of the chamber 21. A rotation angle of the chamber 21 relative to the adapter 51 can be limited. Since the base 23 remains connected to the side wall 31 of the chamber 21, it cannot be lost or get into the second container, even if the rotation angle of the chamber 21 relative to the adapter 51 is greater than 360°. The niche 22 can generally also be a hollow space.

The invention claimed is:

1. A container, comprising:

a chamber with a base configured for receiving a mixture component; and an adapter configured to fasten the chamber to a second container, the adapter comprising:

a first connector configured to connect to the chamber, the first connector comprising a substantially helical guide track and a sliding projection, the sliding projection being movable in a guided manner along the guide track and in at least in the area of an end of the helical guide track, a step forms a resistance in relation to the movement of the sliding projection along the guide track;

a second connector configured to connect to the second container;

a flow channel for the mixture component extending between the first connector and the second connector; and a blade element in the flow channel with a blade facing toward the chamber for opening the base, the first connector enabling a rotation of the chamber relative to the adapter and to the blade, wherein the blade is positioned so as to sever the base of the chamber along an edge of the base upon rotation of the chamber and wherein the chamber and the adapter are non-detachably connected to one another.

2. The container of claim 1, wherein the chamber has a seal that extends along the edge of the base and is positioned to come into contact with the blade and to cooperate therewith in a sealing manner before or while the blade is in contact with a part of the base to be severed.

3. The container of claim 1, wherein an outer diameter and an inner diameter of the chamber are smaller at a base-side end than at an opposite end of the chamber.

4. The container of claim 1, further comprising a projection on an outside of the chamber, an outer diameter of the chamber being greater at a location of the projection than an inner diameter of the adapter on a side thereof facing toward the chamber.

5. The container of claim 4, further comprising a removable spacer between the projection and an edge of the adapter to prevent a convergence of the projection and the edge of the adapter.

6. The container of claim 4, wherein the projection encloses the chamber at least in part along a periphery of the chamber, the projection forming a seal that is positioned to cooperate in a sealing manner with the edge of the adapter upon contact therewith.

7. The container of claim 1, wherein the blade is positioned to detach the base of the chamber only partially from the chamber upon rotation of the chamber, the rotation of the chamber relative to the adapter being limited in relation to a maximum rotation angle.

8. The container of claim 1, wherein rotation of the chamber relative to the adapter is limited with respect to a maximum rotation angle to less than 360 degrees.

9. The container of claim 1, wherein the blade element is connected to the adapter and defines a flow opening for the mixture component, the blade being arranged at an edge of the flow opening.

10. The container of claim 9, wherein the flow opening narrows in a direction of the second connector to form a funnel, and further comprises a recess for receiving the edge of an opening of the second container between the funnel and a side wall of the adapter.

11. The container of claim 1, wherein the container is configured for a single use.

12. The container of claim 1, wherein the blade and the adapter are integrally formed.

13. The container of claim 1, wherein the second container is non-detachably connected to the container.

14. A container, comprising:

a chamber with a base configured for receiving a mixture component; and an adapter configured to fasten the chamber to a second container, the adapter comprising:

a first connector configured to connect to the chamber, the first connector comprising a substantially helical guide track and a sliding projection, the sliding projection being movable in a guided manner along the helical guide track and a second guide track that is shorter in length than the helical guide track, the second guide track and the helical guide track meeting at an acute angle proximate their ends;

a second connector configured to connect to the second container;

a flow channel for the mixture component extending between the first connector and the second connector; and a blade element in the flow channel with a blade facing toward the chamber for opening the base, the first connector enabling a rotation of the chamber relative to the adapter and to the blade, wherein the blade is positioned so as to sever the base of the chamber along an edge of the base upon rotation of the chamber and wherein the chamber and the adapter are non-detachably connected to one another.

15. The container of claim 14, wherein the chamber has a seal that extends along the edge of the base and is positioned to come into contact with the blade and to cooperate therewith in a sealing manner before or while the blade is in contact with a part of the base to be severed.

16. The container of claim 14, wherein an outer diameter and an inner diameter of the chamber are smaller at a base-side end than at an opposite end of the chamber.

17. The container of claim 14, further comprising a projection on an outside of the chamber, an outer diameter of the chamber being greater at a location of the projection than an inner diameter of the adapter on a side thereof facing toward the chamber.

18. The container of claim 17, further comprising a removable spacer between the projection and an edge of the adapter to prevent a convergence of the projection and the edge of the adapter.

19. The container of claim 17, wherein the projection encloses the chamber at least in part along a periphery of the chamber, the projection forming a seal that is positioned to cooperate in a sealing manner with the edge of the adapter upon contact therewith.

20. The container of claim 14, wherein the blade is positioned to detach the base of the chamber only partially from the chamber upon rotation of the chamber, the rotation of the chamber relative to the adapter being limited in relation to a maximum rotation angle.

21. The container of claim 14, wherein the blade element is connected to the adapter and defines a flow opening for the mixture component, the blade being arranged at an edge of the flow opening.

22. The container of claim 21, wherein the flow opening narrows in a direction of the second connector to form a funnel, and further comprises a recess for receiving the edge of an opening of the second container between the funnel and a side wall of the adapter.

23. A container, comprising:

a chamber with a base configured for receiving a mixture component; and an adapter configured to fasten the chamber to a second container, the adapter comprising:

a first connector configured to connect to the chamber, the first connector comprising a substantially helical guide track and a sliding projection, the sliding projection being movable in a guided manner along the guide track, at least one end of the guide track comprising a stop for the sliding projection;

a second connector configured to connect to the second container;

a flow channel for the mixture component extending between the first connector and the second connector; and a blade element in the flow channel with a blade facing toward the chamber for opening the base, the first connector enabling a rotation of the chamber relative to the adapter and to the blade, wherein the blade is positioned so as to sever the base of the chamber along an edge of the base upon rotation of the chamber and wherein the chamber and the adapter are non-detachably connected to one another.

24. The container of claim 23, wherein the chamber has a seal that extends along the edge of the base and is positioned to come into contact with the blade and to cooperate therewith in a sealing manner before or while the blade is in contact with a part of the base to be severed.

25. The container of claim 23, wherein an outer diameter and an inner diameter of the chamber are smaller at a base-side end than at an opposite end of the chamber.

26. The container of claim 23, further comprising a projection on an outside of the chamber, an outer diameter of the chamber being greater at a location of the projection than an inner diameter of the adapter on a side thereof facing toward the chamber.

27. The container of claim 23, wherein the blade is positioned to detach the base of the chamber only partially from the chamber upon rotation of the chamber, the rotation of the chamber relative to the adapter being limited in relation to a maximum rotation angle.

28. The container of claim 23, wherein the blade element is connected to the adapter and defines a flow opening for the mixture component, the blade being arranged at an edge of the flow opening.

29. The container of claim 28, wherein the flow opening narrows in a direction of the second connector to form a funnel, and further comprises a recess for receiving the edge of an opening of the second container between the funnel and a side wall of the adapter.

30. The container of claim 27, further comprising a removable spacer between the projection and an edge of the adapter to prevent a convergence of the projection and the edge of the adapter.

31. The container of claim 28, wherein the projection encloses the chamber at least in part along a periphery of the chamber, the projection forming a seal that is positioned to cooperate in a sealing manner with the edge of the adapter upon contact therewith.

* * * * *